US006158548A

United States Patent [19]

May

[11] Patent Number: 6,158,548

[45] Date of Patent: Dec. 12, 2000

[54] PERSONAL SAFETY DEVICE

[75] Inventor: Harry Stanley May, Tyne & Wear, United Kingdom

[73] Assignee: Barrow Hepburn Sala Ltd., United Kingdom

[21] Appl. No.: 09/047,229

[22] Filed: Mar. 25, 1998

Related U.S. Application Data

[63] Continuation of application No. 08/637,717, filed as application No. PCT/GB94/92719, Dec. 13, 1994.

[30] Foreign Application Priority Data

Dec. 14, 1993 [GB] United Kingdom ..... 9325508
Dec. 13, 1994 [WO] WIPO ..... PCT/GB94/92719

[51] Int. Cl.[7] ..... A62B 35/04
[52] U.S. Cl. ..... 182/3; 182/6; 182/18
[58] Field of Search ..... 182/3, 18, 6

[56] References Cited

U.S. PATENT DOCUMENTS 2,888,063 5/1959 Rose .
3,444,957 5/1969 Ervin ..... 182/3
4,253,544 3/1981 Dalmaso .
5,325,818 7/1994 Leach .

FOREIGN PATENT DOCUMENTS 0 200 075 11/1986 European Pat. Off. .
0 508 278 10/1992 European Pat. Off. .
2 044 905 2/1971 France .
2 269 357 11/1975 France .
3604973 8/1987 Germany .
WO 89/10160 11/1989 Sweden .

*Primary Examiner*—Alvin Chin-Shue
*Attorney, Agent, or Firm*—Nixon & Vanderhye P.C.

[57] ABSTRACT

A personal safety device comprising a harness, a positioning strap attached to spaced apart region on the harness by way of a transfer strap. The ends of the positioning straps disconnect from the harness on the application of a force exceeding a predetermined limiting value.

6 Claims, 4 Drawing Sheets

PERSONAL SAFETY DEVICE

This is a continuation of application Ser. No. 08/637,717, filed Apr. 30, 1996, now pending, which was filed pursuant to 35 USC § 371 of PCT application No. PCT/GB94/02719 filed Dec. 13, 1996.

TECHNICAL FIELD

This invention relates to safety devices such as are worn by users exposed to the risk of falling from a height from an elevated structure such as a tree, a pole or a building.

BACKGROUND ART

Conventional safety devices commonly take the form of a body harness including shoulder straps and leg loops, the harness being provided at front and/or rear with strap attachment rings so that a user can employ a lanyard or like strap extending between at least one of the strap attachment rings on the body harness and a strong anchorage point on the pole, tree or like structure on which the user is working or mounted in order to arrest the user should he inadvertently fall from the elevated structure. Such aforementioned strap attachment rings are provided on the harness at front and/or rear in regions at or above the level of the user's chest. Such an arrangement has the almost essential characteristic that when a fall is arrested the user is subjected to shock loading when the user is so oriented that he is disposed substantially upright or with the major axis of his body substantially aligned with the direction in which the shock force acts. In this upright or aligned posture shock load is distributed by the harness to straps which pass between the legs of the user and this reduces greatly any injurious effect.

It is also known to provide such a harness with a belt worn about the user's waist and to which may be attached a positioning strap which can be connected to or looped around a pole or the like on which the user is working or mounted to help him position himself on the pole. Such a pole positioning strap is commonly attached to one or more of a pair of rings secured to the waist belt and located one adjacent each of the hips of the user. Should the user slip when wearing such a waist belt, the positioning strap will also act to arrest the fall; but in this case shock loading will be transmitted by way of these rings to the waist belt of the user. However, because it is worn around the waist of the user, there is a significant risk associated with the mechanics of a fall, even a fall not exceeding 1 meter, that excessive shock transmitted to the user by way of a waist belt could be effective to cause very serious injury to the user. There is also a possibility of misuse of such a harness equipped with strap attachment rings one adjacent each hip of the user, that a safety lanyard could be attached to a said ring, thus placing the user at risk of severe injury in the event of a fall arrested by the lanyard.

It would be desirable to be able to provide a personal safety device the construction of which was such as to eliminate or at least substantially reduce the possibility of injury due to shock loading being transmitted to the body of the user by a waist belt in the event of a fall. Such intention might be assisted by eliminating from such a harness all strap attachment rings located at or below the level of the waist of the user. However the provision of such rings, one adjacent each of the users hips, has proved to be extremely useful for attaching a pole strap for aiding work on poles carrying power or telegraph cables, or for work in trees.

DISCLOSURE OF THE INVENTION

In order to reduce the possibility of excessive and harmful shock load being transmitted to the waist region of the user of the harness it is now proposed according to the theory underlying this invention, to provide means whereby excessive shock loads, such as arise in the event of a fall and which would otherwise be experienced at the user's waist region, are instead, transferred, preferably in attenuated form, to an upper region of the harness at or above the level of the user's chest. In furtherance of this general objective, while the harness may well include one or more strap attachment rings secured to the harness at or above the level of the chest of the user, such strap attachment rings being adapted and arranged to transmit heavy shock load to the harness in a manner in which risk of injury is minimised, any strap attachment rings provided on the harness at locations which are at or below the waist level of the user are, according to the invention, secured to the harness by means of fastening devices which rupture when force exceeding a predetermined limit is occasioned at such rings; and the invention also embraces the feature that force transfer link means are provided whereby, following rupture of such fastening devices, such otherwise excessive force is transferred instead to a strap attachment ring located in a region at or above the level of the user's chest; and preferably such force is attenuated during such transfer.

Thus the user is afforded some measure of protection even against misuse of his equipment, in the event that he fastens a safety lanyard to rings at or below his waist level, contrary to instructions that such safety lanyards should only be fastened to strap attachment rings located in regions at or above the user's chest level.

There are a number of ways of carrying the invention into practical effect. For example it is possible to utilise a waist belt which has conventional fastening means in the form of one or more buckles and such waist belt will mount two said strap attachment rings adapted in use to be located, one adjacent each of the hips of the user. However, in one embodiment of the invention such rings are attached to a component of the belt which is fastened to the remainder of the belt by two sets of fastening means which rupture when the component of the belt carrying the strap attachment rings is subjected to a force which exceeds a predetermined limiting force. Such a fastening means can comprise two lengths of webbing sewn together with threads which rupture. Such a fastening can be made which can withstand, without breaking, a force of the order of 2.5 kN; but the threads begin to rupture when a higher force is experienced. When this occurs and the two sets of fastening means rupture, in rapid succession, the belt component carrying the rings flies free of the remainder of the belt which may remain at the user's waist. The component of the belt which flies free is advantageously attached, by means of a transfer link, to a ring secured to the harness preferably at a chest strap of the harness. Preferably this transfer link includes a longitudinally extensible shock absorber device which is effective to attenuate shock loads transmitted to the chest strap of the harness. Such a shock absorber device may be of the kind in which one or more strips of folded webbing are secured in folded condition by threads which rupture during unfolding of the webbing. Alternatively the shock absorber device may comprise two strips of webbing which are interwoven by threads which rupture when subjected to excessive force.

Accordingly, one preferred embodiment of the invention comprises a full body harness having shoulder straps and leg straps all secured together, and including a belt having ends secured closed by fastening means which rupture when the belt is subjected to loading exceeding a predetermined limit, said belt being connected and attached by a load transfer link to a chest strap which bridges and is secured to said shoulder straps, all whereby shock load exceeding said predetermined limit acting on said belt causes first, said fastening means to rupture so that said belt ceases to be closed, and thereafter, shock load to be transmitted by way of said load transfer link to said chest strap and thence distributed by way of said shoulder straps to said leg straps. Advantageously, the load transfer link incorporates a longitudinally extensible shock absorbing device capable of attenuating shock loads transmitted to said chest strap.

Preferably, in addition to the fastening means which rupture when the belt is subjected to loading which exceeds a predetermined force limit thereby to open said belt, the belt is equipped with one or more buckle closure devices which can be manipulated to open and close the belt, said buckle device or devices remaining closed when said belt is subjected to loading which exceeds said predetermined limit and causes opening of the rupturable fastening means.

As is mentioned above, the fastening means which rupture when the belt is subjected to loading which exceeds a predetermined limit thereby to open the belt, comprise, at one or more locations along the extent of the belt, two lengths of webbing which are stitched together by threads which rupture when the belt is subjected to excessive loading, the two lengths of webbing coming apart following said rupture, thereby to open the belt. The belt is preferably capable of remaining closed when sustaining force of up to of the order of 2.5 Kn, and yet will rupture when the predetermined limiting force and rate of rise of force are exceeded.

Such a belt having fastening means capable of rupturing, preferably comprises front and rear components, the rear component being permanently connected to the harness and the front component being connected to the rear component by two sets of fastening means which rupture when subjected to force exceeding a predetermined limiting force.

The harness may inseparably include a waistband in addition to said belt having fastening means capable of rupturing. This waistband may serve to provide that the various straps of the harness are maintained in intended location relative to one another, so that the shoulder straps and the legs straps are well and properly positioned on the body of the user; and such waistband may mount a seat strap.

According to another aspect of the invention there is provided a personal safety device comprising a body harness including a pair of shoulder straps, a pair of leg loops, a positioning strap and means for attaching the positioning strap to spaced apart regions of the harness at or adjacent the waist thereof, characterised in that transfer means react between the positioning strap and the harness, the means of attachment of the positioning strap to the harness being disconnectable or displaceable from said spaced apart regions on the application of a force exceeding a predetermined limiting value, the transfer means thereupon transmitting said force between the positioning strap and an upper region of the harness.

With such an arrangement, and should the user begin to fall, the positioning strap is decoupled from the waist region of the harness, and the forces associated with the fall are transmitted to the body harness through the transfer means to be absorbed substantially by the leg loops of the harness, thereby avoiding the possibility of dangerous forces being applied to the waist region of the user. Thus such a device provides a positioning system which converts to fulfil an arrest role in the event of an inadvertent fall.

Conveniently the transfer means incorporates energy absorbing means.

In a preferred embodiment of the invention, the transfer means comprise a first transfer strap to which the ends of the positioning strap are securely attached, the ends of the first transfer strap being disconnectably or releasably attached to said spaced apart regions of the harness, and a second transfer strap secured to, to react between, the first transfer strap and the body harness.

Preferably the ends of the first transfer strap are attached to the spaced apart regions of the harness by stitching which, on the application thereto of said force exceeding the predetermined limiting value, ruptures to release the first transfer strap from the harness.

The device may include a waist belt interconnected with the harness, said disconnectable or displaceable means of attachment being to the waist belt.

In an alternative arrangement, the device may include a rear belt in the waist region of the harness, said spaced apart regions of the harness being located at or adjacent the ends of said rear belt.

Preferably the body harness includes a connecting strap extending across the chest of the user between the shoulder straps and on which is provided a front anchorage point, the upper end of the transfer means being secured to said front anchorage point.

DETAILED DESCRIPTION OF THE PREFERRED EMBODIMENTS

Figure 1:
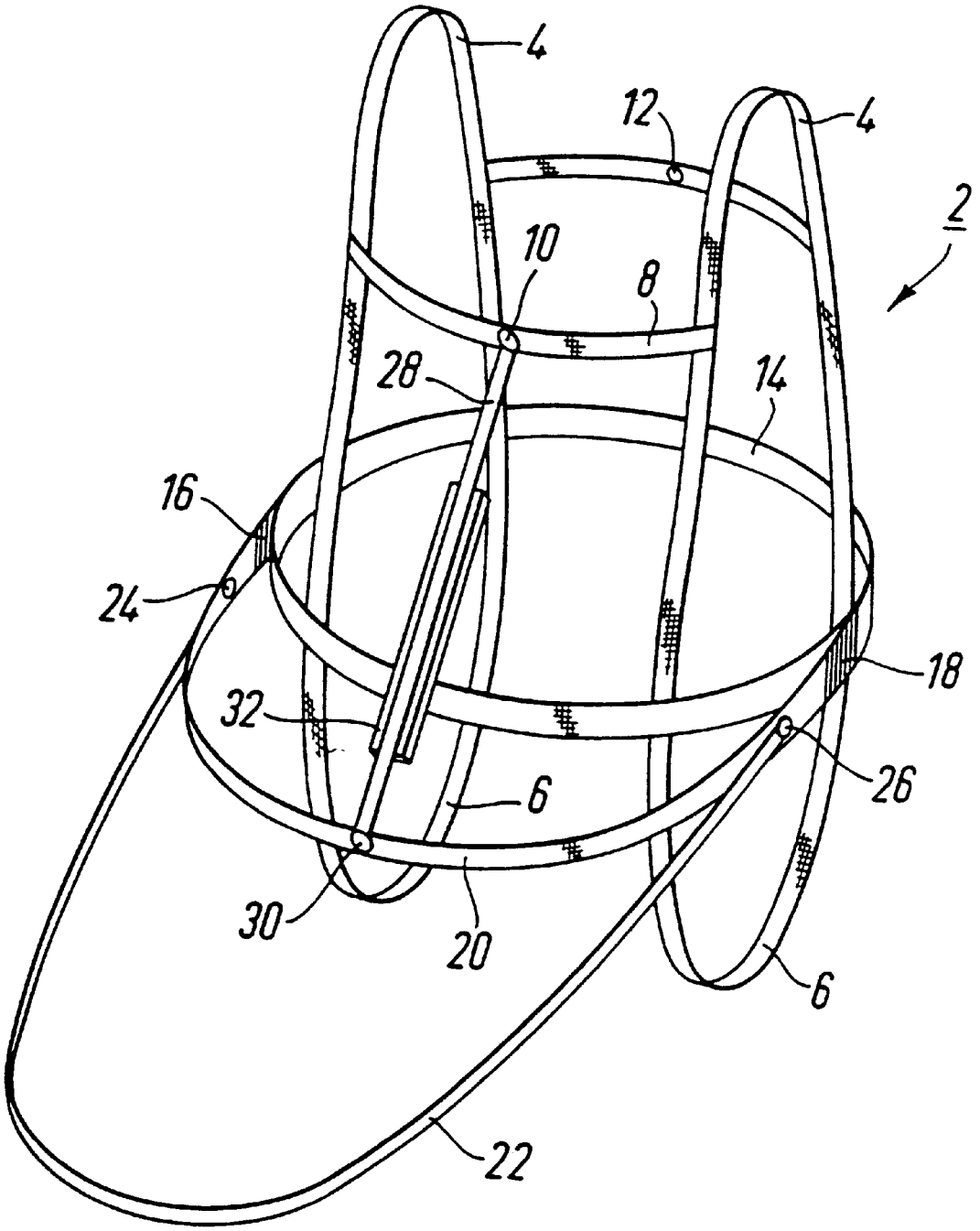
FIG. 1 is a simplified isometric view of a first safety device according to the invention.
Figure 2:
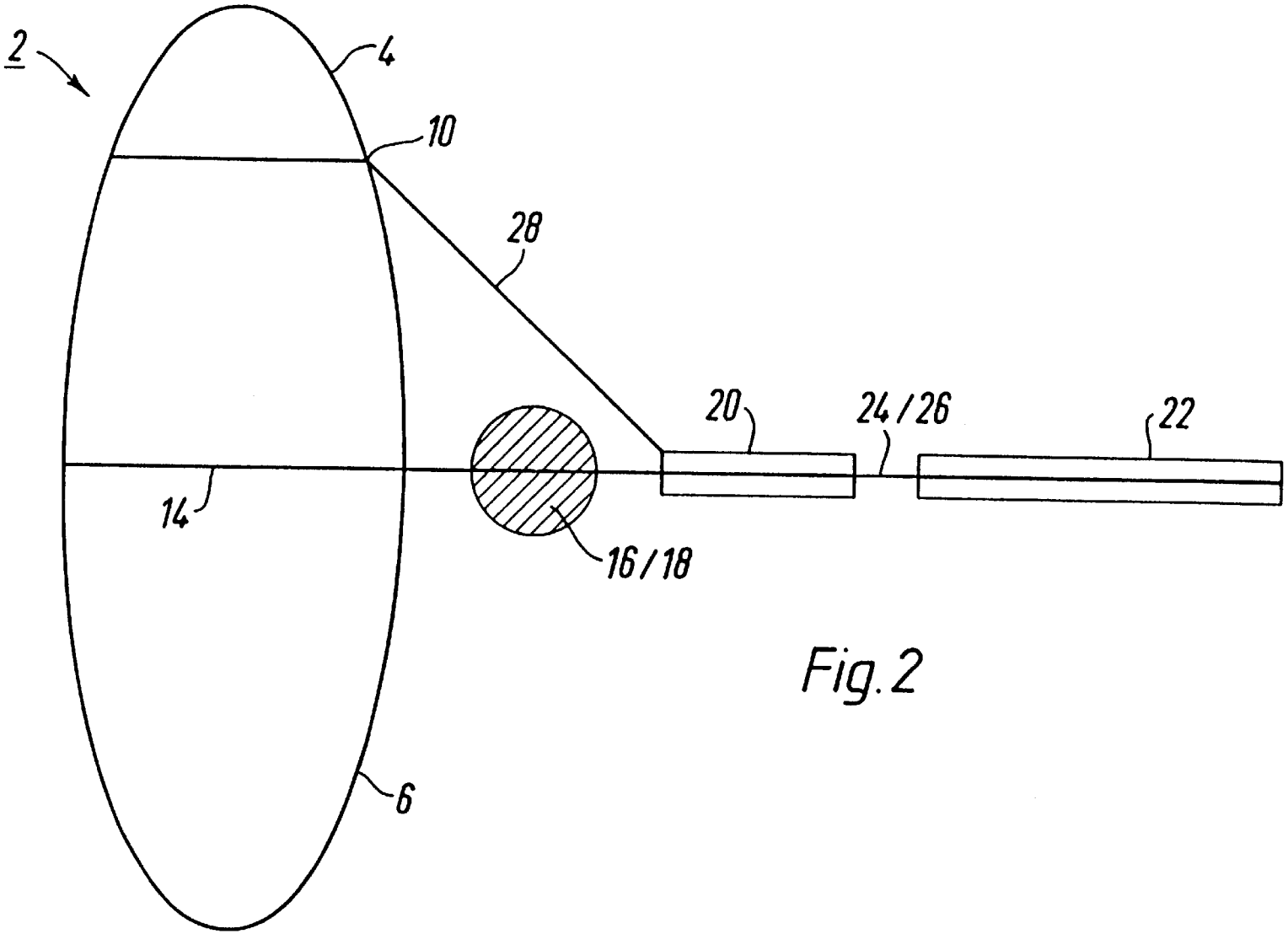
FIG. 2 is a schematic side view of the safety device of FIG. 1.

The safety device illustrated in FIGS. 1 and 2 comprises a body harness indicated generally at 2 having shoulder straps 4, leg loops 6, a front connecting strap 8 between the shoulder straps, a front anchorage point 10 on the connecting strap 8, and a rear anchorage point 12.

Connected to the body harness 2 is a waist belt 14 to fit around the waist of the user, said waist belt 14 being integrated with the shoulder straps 4 and leg loops 6.

The waist belt 14 is provided with left and right hand connection points 16, 18 for attachment thereto of the respective ends of a first transfer strap 20.

More particularly said connection points 16, 18 are of a rupturable nature, and preferably comprise stitching between the waist belt 14 and the ends of the first transfer strap 20 which, on the application thereto of a force exceeding a predetermined limiting value, breaks to allow the first transfer strap 20 to be released from the waist belt.

The ends of a positioning strap 22 are securely connected to spaced apart regions 24, 26 on the first transfer strap 20, while a second transfer strap 28 has one end secured at 30 to the first transfer strap 20 and the other end secured to the front anchorage point 10 of the body harness. The strap 28 incorporates an energy absorber 32.

The described device operates as follows. On the application of an excessive force to the positioning strap 22, such as would occur if the user inadvertently fell and which is typically 2.5 kilonewtons, the connections at 16, 18 of the first transfer strap 20 to the waist belt 14 are broken by the sudden rise in the force transmitted from the positioning strap 22 to the first transfer strap 20 by way of the connections at 24, 26.

The first transfer strap 20 and the positioning strap 22 are then connected to the body harness 2 only by the second transfer strap 28 secured to the anchorage point 10 in the upper regions of the harness 2. Thus the forces resulting from the fall are transmitted to the body harness 2 by way of the strap 28 and more particularly to the leg loops 6 whereby said forces are more safely accommodated than herebefore. The incorporation of the energy absorber 32, which is preferably of the longitudinally extensible type, in the strap 28 further reduces the severity of the forces imposed on the user in the event of a fall.

The integration of the waist belt 14 in the harness 2 results in a sufficient degree of resistance to movement of the waist belt 14 in the event of a fall being produced by the leg loops 6 to ensure the disconnection of the transfer belt 20 from the waist belt 14 and the subsequent transfer of the forces to the body harness through the strap 28.

The described safety device provides a positioning system which converts to fulfil an arrest role in the event of an inadvertent fall.

The concept may be utilised in isolation or in combination with other fall arrest systems, and is capable of being employed to complement the effective operation of such systems. This can be compared with the use of conventional combinations of systems which can create complex interreactions with undesirable outcomes.

The arrangement of the invention prevents a fall from resulting in undesirable and excessive forces being applied to the positioning strap or to the waist region of the harness, and instead ensures the safe transfer of arrest forces to the anchorage point on the upper regions of the harness in such a manner as to maintain the body in an appropriate attitude and arrest falls safely.

The embodiment of FIGS. 1 and 2 incorporates a waist belt 14 to which the first transfer strap 20 is releasably attached.

However, in its broadest concept, the safety device of the invention need not include a waist belt as such, the transfer means, in particular the first transfer belt 20, being releasably attached to the harness in the waist region thereof.

Figure 3:
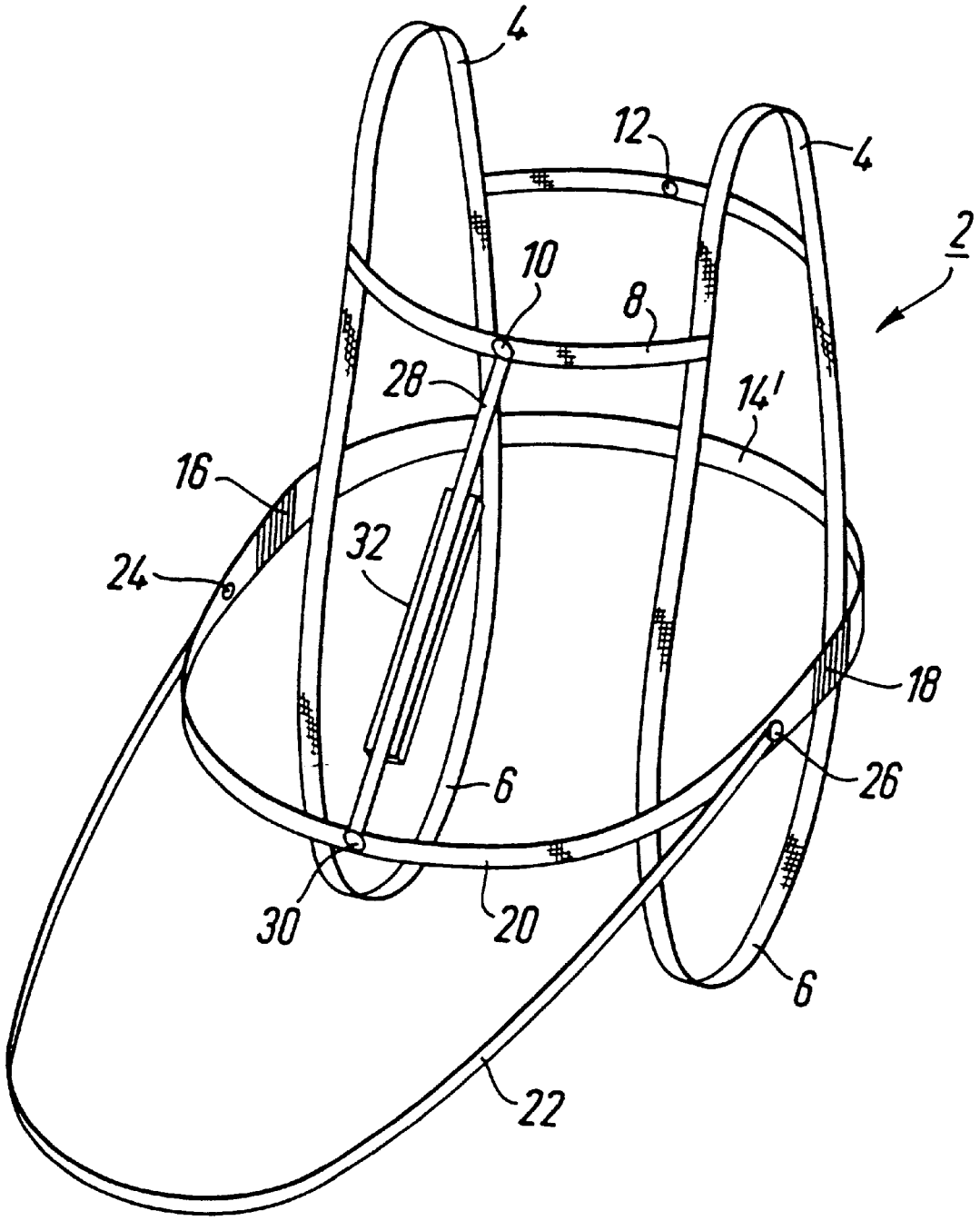
FIG. 3 is a simplified isometric view of a second safety device according to the invention.

As a further alternative, and as shown in FIG. 3, the waist belt 14 may be eliminated, and may be replaced by a rear half-belt 14' to the ends of which the first transfer belt 20 is releasably attached by means of the connections 16, 18. The half-belt 14' may or may not be integrated with the harness 2.

In a non-illustrated embodiment, there are a pair of transfer straps the lower ends of each of which are releasably attached to opposed sides of the waist belt 14 in the manner of the ends of the strap 20, the upper ends of said pair of transfer straps each being securely connected to an associated one of the shoulder straps 4 adjacent the connecting strap 8.

The ends of the positioning strap 22 are secured to the lower ends of the pair of transfer straps so that, on disconnection of said lower ends of the transfer straps from the waist belt in the event of a fall, the positioning strap remains secured by said pair of transfer straps, and the forces on said positioning strap are transferred to the shoulder straps of the body harness by way of said pair of transfer straps.

Figure 4:
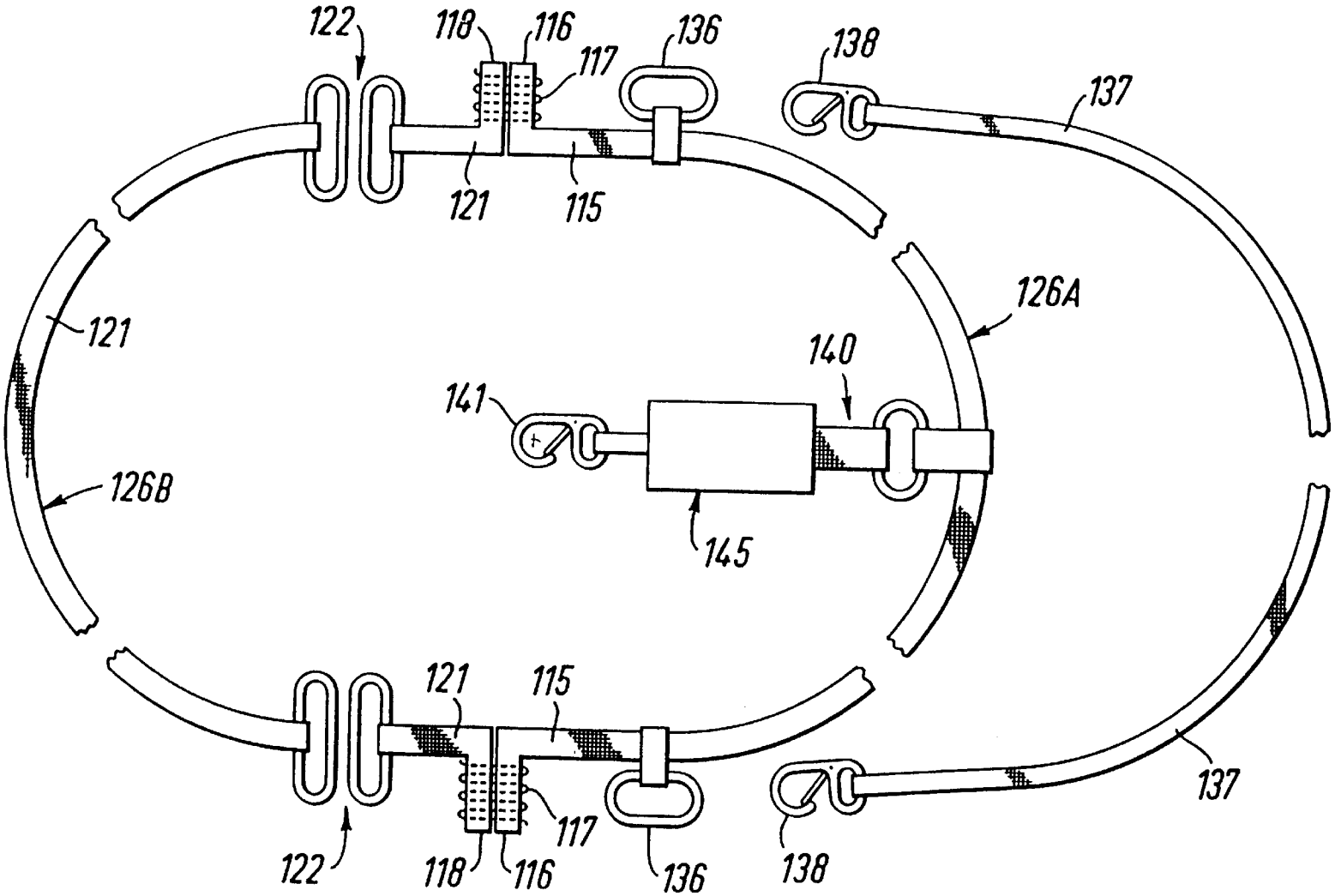
FIG. 4 is a diagrammatic plan view of another embodiment of safety device according to the invention.

The apparatus shown in FIG. 4 comprises a two component belt intended to be worn around the waist of a user. It is intended to be so worn in conjunction with a full body harness (not shown) comprising at least shoulder straps interconnected with leg straps; and the shoulder straps will be bridged by a chest strap as is per se well known. Means will be provided for adjusting the lengths of the various straps.

This belt as shown comprises a front component 126A and a rear component 126B; the components 126A and 126B may incorporate means (not shown) whereby the girth of the belt can be altered.

The rear component 126B includes webbing bands 121 interrupted by a pair of clasps 122 which are each of conventional per se known type. For example and as shown each clasp 122 may comprise a pair of rings which can be interlocked by inserting one ring through the other; unclasping being effected by reversing this process. Any analogous fastening device such as a buckle may be employed as a clasp. Although there are preferably two clasps, one of the clasps may be omitted.

The front belt component 126A comprises a single band of webbing 115 terminating at each end in a length 116 which is stitched by threads 117 to a corresponding webbing length 118 of the belt rear component 126B. The threads 117 are arranged and adapted to rupture when the belt is subjected to a force which exceeds a predetermined limiting force say 2.5 kN and when the threads rupture the lengths 116 and 118 move apart so that the belt front component 126A can move freely away from the belt rear component 126B.

The belt front component 126A mounts a pair of strap attachment rings 136. A pole strap 137 has end hooks 138 which can be engaged with the rings 136. In use, the rings 136 will be located one adjacent each hip of the user and the strap 137 connected to the rings will pass around a pole or the like in order to assist positioning of the user while he is working on the pole.

The belt front component 126A also mounts a load transfer link 140 which includes a connecting hook 141 by which the transfer link 140 may be secured to an upper region of a full body harness (not shown in this drawing). For example the hook 141 may be secured to a chest strap which bridges the shoulder straps of a full body harness at the location of the chest of the user. Integrally incorporated in the transfer link 140 is a longitudinally extensible shock absorbing device 145 which is of any convenient known type. For example the device 145 may be of the kind comprising folded webbing the folds being secured by stitched threads, these threads breaking as the webbing unfolds, or may comprise two strips of webbing which are interwoven by threads which rupture when subjected to excessive force. Devices of these types are well known in the art.

Accordingly, in this embodiment of the invention the belt has front and rear components 126A and 126B secured closed by fastening means secured by threads 117 which rupture when the belt is subjected to loading exceeding a predetermined limit, and this belt is connected and attached by the load transfer link 140 preferably to a chest strap which bridges and is secured to shoulder straps of a full body harness. And when excessive shock load acts on said belt, this causes first, said fastening means 117 to rupture so that said belt ceases to be closed, and thereafter, shock load is transmitted by way of said load transfer link 140 to the chest strap and thence distributed by way of shoulder straps to leg straps forming part of the full body harness. And as shown, the load transfer link 140 incorporates the longitudinally extensible shock absorbing device 145 capable of attenuating shock loads transmitted at the hook 141 to said chest strap.

When a pole strap, such as the strap 137, or a lanyard, is secured to a strong anchorage on a fixture, and also to one or both of said rings 136, which in use are located adjacent the hips of the user, then in the event of a fall, and when excessive shock load is transmitted to the belt front component 126A, the fastening means 116 rupture and the belt front component flies free. This removes the possibility that potentially injurious shock loading is transmitted to the user by way of one or both of the hip rings 136. Then, by way of the load transfer link 140, the shock occasioned when the fall is arrested, is transmitted to the hook 141 which will be attached to an upper region of the full body harness, preferably at the location of the chest of the user, the severity of this loading having been attenuated by operation of the device 145.

The forces will then be distributed throughout the harness to the leg straps and when the fall arrest has been completed, the body of the user will be held by the harness in a generally upright posture, shock forces having been delivered in a manner which involves least risk of injury. In particular hardly any of the shock force will have been delivered to the user by way of his waist belt. The shock forces will be delivered when the falling body has its major axis generally aligned with the direction of the delivered force rather than the body having its major axis disposed transversely of the direction of the force as it is applied.

The clasps 122, or analogous buckle closure devices, are strong fastening devices and will remain closed when the belt is subjected to loading which exceeds said predetermined limit and causes opening of the rupturable fastening means. The rear belt component 126B may be attached to a waist band forming part of the full body harness.

Preferably one of the rings 136 is connected to one end of the pole strap 137 by a releasable hook while the other of the rings 136 is constituted as a contrivance which engages the pole strap at a location intermediate the length of the strap and in a manner which is adjustable along said length all whereby the effective loop of the pole strap can be altered in size as may be required by the user.

Also it will be appreciated that the link 140 may be connected to one of the rings 136, or it may be connected to a separate ring, such as the ring 146, on the belt front component 126A.

Other modifications and variations to the safety device, which can be used by workmen or sportsmen involved in various activities, will be apparent to those skilled in the art. For example, the rupturable connections may be achieved by other than stitching, while the positioning strap 20 may be looped as shown and require two connections to the harness, or may be such as to have one end only connected to the harness with the other end anchored to an associated structure or the like.

Although the above description refers to the excessive forces applied to the device as resulting from an accidental fall of the user, such forces may be applied to the user as a result of factors associated with the structure on which the user is working or mounted, for example on breakage of the limb of a tree chosen for anchorage purposes.

I claim:

1. A fall-arrest assembly in combination with a body harness, comprising:

a first transfer strap (20) having opposite ends connected to the harness (2), thereby defining respective first junctures (16, 18) which rupture when subjected to a threshold force;

a second transfer strap (28) having one end connected to the first transfer strap and an opposite end connected to the harness, thereby defining respective second junctures (30, 10) which remain intact when subjected to the threshold force; and a positioning strap (22) having opposite ends connected to the first transfer strap, thereby defining respective third junctures (24, 26) which remain intact when subjected to the threshold force, wherein when the assembly is subjected to the threshold force, the first junctures rupture, and the second junctures, the third junctures, and the harness remain intact, leaving the first transfer strap and the second transfer strap connected in series between the positioning strap and the harness.

2. The combination of claim 1, wherein the opposite end of the second transfer strap is connected to a chest strap (8) on the harness.

3. The combination of claim 2, wherein the opposite ends of the first transfer strap are connected to a waist belt (14) on the harness.

4. The combination of claim 1, wherein the opposite ends of the first transfer strap are connected to a waist belt (14) on the harness.

5. A safety device of the type that arrests the fall of a person, comprising:

a body harness (2) adapted to remain intact in response to application of a threshold force;

a first transfer strap (20, 126A, 126B) adapted to be secured relative to a person's waist and to break away from the person's waist in response to application of the threshold force;

a second transfer strap (28, 140) interconnected between the harness and the first transfer strap and adapted to remain intact in response to application of the threshold force; and a positioning strap (22, 137) connected to the first transfer strap and adapted to remain intact in response to application of the threshold force, wherein when the device is subjected to the threshold force, the first transfer strap is pulled taut between the positioning strap and the second transfer strap, and the second transfer strap is pulled taut between the first transfer strap and the harness, wherein the first transfer strap has opposite ends (16, 18) which overlap discrete portions of a waist belt (14) on the harness, and which are connected thereto by stitching which is adapted to rupture in response to application of the threshold force.

6. A fall arrest assembly, comprising:

a harness (2) defined by harness straps (4, 6, 8, 14) arranged into closed loops about a space;

a first additional strap (20) having opposite ends (16, 18) connected to first and second portions of the harness, wherein the first additional strap and the space cooperate to define a first closed loop outside the space;

a second additional strap (22) having opposite ends (24, 26) connected to first and second intermediate portions of the first additional strap, wherein the second additional strap and the first additional strap cooperate to define a second closed loop outside the space; and a third additional strap (28) having a first end (30) connected to a central portion of the first additional strap, and having a second, opposite end (10) connected to a third portion of the harness, wherein when threshold forces are applied in opposite directions against the second additional strap and the harness, the harness remains intact, and the opposite ends of the first additional strap separate from the first and second portions of the harness.

* * * * *

UNITED STATES PATENT AND TRADEMARK OFFICE

CERTIFICATE OF CORRECTION

PATENT NO. : 6,158,548
DATED : December 12, 2000
INVENTOR(S) : Harry Stanley May It is certified that error appears in the above-identified patent and that said Letters Patent is hereby corrected as shown below:

Column 1,
Line 6, delete "1996" and therefore -- 1994 --

Column 8,
Line 58, delete "space" and insert therefore -- harness --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*